United States Patent [19]

Feder

[11] 4,158,406

[45] Jun. 19, 1979

[54] GARMENT CONTAINER

[76] Inventor: Aaron Feder, 800 Ocean Pkway., Brooklyn, N.Y. 11230

[21] Appl. No.: 877,615

[22] Filed: Feb. 14, 1978

[51] Int. Cl.[2] ..... B65D 85/18

[52] U.S. Cl. ..... 206/279; 206/290

[58] Field of Search ..... 206/290, 279, 289

[56] References Cited

U.S. PATENT DOCUMENTS

| | | | |
|---|---|---|---|
| 1,455,063 | 5/1923 | Batts | 206/279 |
| 1,617,365 | 2/1927 | Batts | 206/279 |
| 1,626,381 | 4/1927 | Batts | 206/279 |
| 1,954,607 | 4/1934 | Wheary | 206/289 |
| 2,256,913 | 10/1953 | Kaplan | 206/290 X |
| 3,337,030 | 8/1967 | Miller et al. | 206/290 |

*Primary Examiner*—Davis T. Moorhead

*Attorney, Agent, or Firm*—Stephen E. Feldman; Marvin Feldman

[57] ABSTRACT

A relatively flat corrugated board container is fitted at each of its ends with hanger holding bars so that a number of garments, each disposed on a hanger, may be layed flat in the container with their respective hangers in alternate fashion toward each of opposite ends of the container to thus maximize the number of garments that may be placed in a container of a given size. Each hanger holding bar is fabricated from suitable metal in a modified "C" configuration and is secured in place at its respective container end by placing the flanges, which form the ends of the "C," into a channel formed behind a rib embossed into a metal retaining plate that is, in turn, secured in place at the container end by a pair of securing panels also formed of corrugated board. Each hanger bar is disposed so as to be able to slide up so that its upper "C" flange can be pulled away from the retaining plate rib, to enable the hangers to be hooked behind the hanger bar. The hanger bar is then slid back down, after all hangers are in position, to again have its upper "C" flange hooked behind the retaining plate rib to securely lock the hangers in place.

7 Claims, 3 Drawing Figures

GARMENT CONTAINER

BACKGROUND OF THE INVENTION

Field of Application

This invention relates to garment containers; and more particularly to containers for holding garments on hangers.

BACKGROUND OF THE INVENTION

Description of the Prior Art

Considerable numbers of garments (suits, coats, blouses, pants, etc.) have to be gathered up for purposes of shipment, storage and the like. Sometimes such garments are merely folded into boxes or other containers; however, that form of treatment usually results in a garment that becomes creased and must be ironed before subsequent display or use following unpacking.

In an attempt to avoid the aforementioned problems many garments are hung directly on hangers for subsequent storage and transportation purposes. For bulk shipment to single, local destinations it is sometimes acceptable to merely hang the garments upon bars in trucks. Garments transported in this manner, may, however, be dropped on the ground and soiled. In addition this form of handling does not provide an acceptable deterrent against theft; and is totally unacceptable where rapid air transporation is required.

Some garments are stored and/or transported in stand up type garment containers of the type shown and described in U.S. Pat. No. 2,276,569 granted on Mar. 17, 1942 to E. Fried for Shipping Container; in U.S. Pat. No. 2,980,260 granted on Apr. 18, 1961 to I. Richer for Hanger Lock For Garment Shipping Containers; and in U.S. Pat. No. 3,112,027 granted on Nov. 26, 1963 to H. Field Et Al for Hanger Support Bar for Garment Packing Case. However, such containers are relatively large and bulky; and are generally only suitable for many garments. In addition, the construction is such that garments may either fall off the hangers and become wrinkled or damaged, even where relatively complex and expensive locking structures are provided to keep the hangers in place.

Flat garment containers, such as shown and described in U.S. Pat. No. 1,450,171 granted on Apr. 3, 1923 to R. F. Cathbert for Box For Garments, have been devised that are adapted for garments on hangers. Most such containers must receive all hangers at only one end of the container. Thus the number of items that can be placed in the container is limited by the thickness of garments and hangers that fit into the hanger end of the container; even though in such containers there is usually significant space at the side of the container opposite to the hanger end.

Other available garment container constructions, such as shown and described in U.S. Pat. No. 1,617,365 granted on Feb. 15, 1927 to W. H. Batts for Shipping Container For Clothing and in U.S. Pat. No. 1,626,381 granted on Apr. 26, 1927 to W. H. Batts for Shipping Box For Clothing, have been devised to accept hangers (upon which garments are disposed) in alternative fashion from both ends of the container. Such constructions not only limit the number of items that can be placed in the containers by providing a limited number of hanger positions; but also require extra structure to facilitate locking the hangers in place. For example, in the construction shown in U.S. Pat. No. 1,617,365 a separate locking bar is required to keep the hangers in place which, because it is separate, can be lost or otherwise forgotten. In the construction of U.S. Pat. No. 1,626,381 the hanger tops protrude through holes made in the container ends and must be taped over the lock the hangers in place. In either construction it is possible to close and ship the container without locking the hangers in place and if that happens the garments can move in the container and be wrinkled or otherwise damaged.

SUMMARY OF THE INVENTION

It is therefore an object of this invention to provide a new and improved garment container.

It is another object of this invention to provide a new and improved container for storing and/or shipping of garments.

It is yet another object of this invention to provide a new and improved garment container for garments on hangers.

It is yet still another object of this invention to provide a new and improved garment container to receive garments on hangers and so that the hangers can be disposed at opposite ends of the container.

It is yet still a further object of this invention to provide a new and improved garmet container to receive garments on hangers and a flat condition.

This invention involves garment containers; and contemplates providing each of opposite ends of a relatively flat container with a retaining plate that receives a hanger holding bar so that the bar can be moved between a first position that allows the hangers to be hooked behind the bar, and a second position that locks the bar in place behind the retaining plate and secures the hangers in place in the container.

Other objects, features, and advantages of the invention, in its details for construction and arrangement of parts will be seen from the above, from the following description of the preferred embodiment when considered with the drawings and from the appended claims.

DESCRIPTION OF THE PREFERRED EMBODIMENT

For convenience the invention will be described as applied to a garment container, for shipping and/or storage of garments, that is fabricated from corrugated board to particular dimensions, and which has secured to each of opposite inner walls a metal retainer plate by a pair of securing panels also formed of corrugated board and secured in place by adhesive. The retaining plate is formed with an embossed rib which forms a channel to receive the flanges of a modified "C" shaped hanger holding bar also formed from metal. It should be understood, nevertheless, that without departing from the scope of the invention; that the container may be formed of any convenient material and to any desired dimension; that the retaining plate may be fabricated from any convenient and suitable material and secured in place either by panels or other suitable means; that the panels may be of any suitable material and secured in place by any suitable means; that the rib in the retainer plate may be formed by an acceptable process or may be a separate piece of material suitably secured in place; and tha the hanger bar may also be formed of any suitable and acceptable material.

Figure 1:
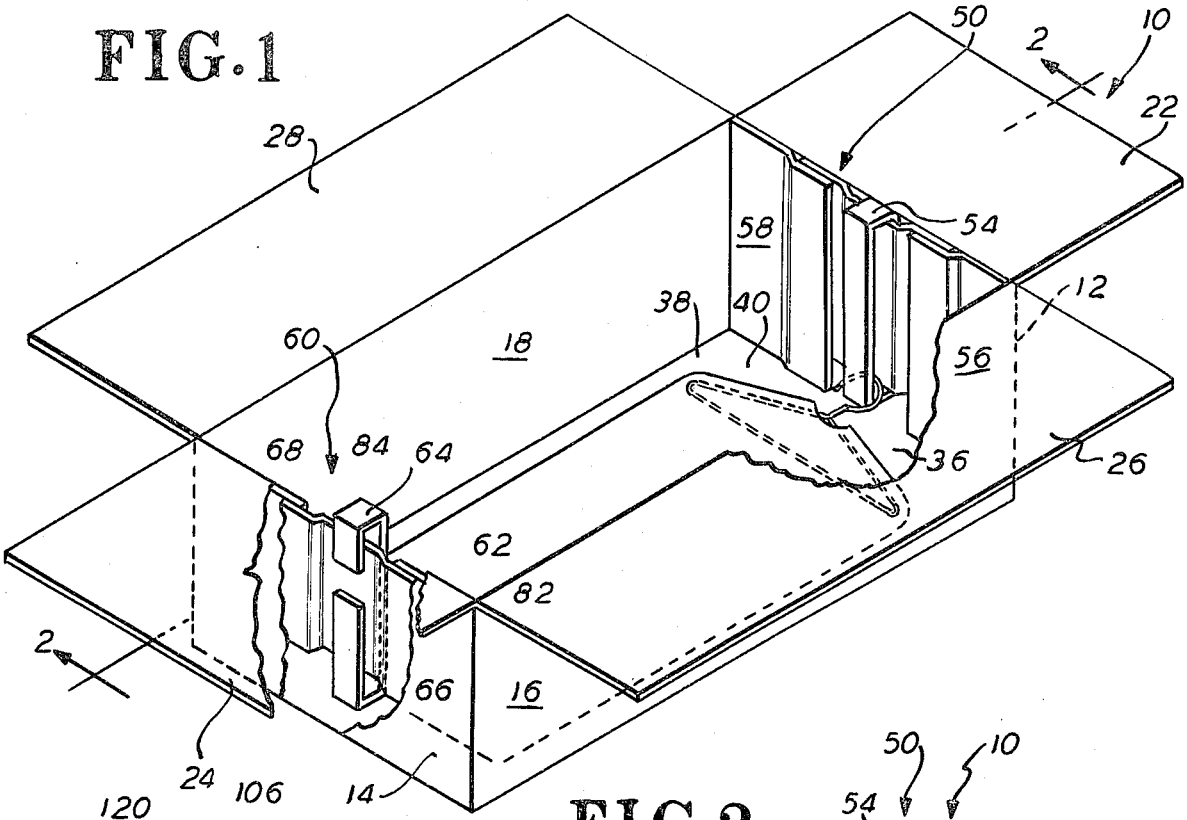
FIG. 1 is a persepective view of a garment container incorporating the instant invention.
Figure 2:
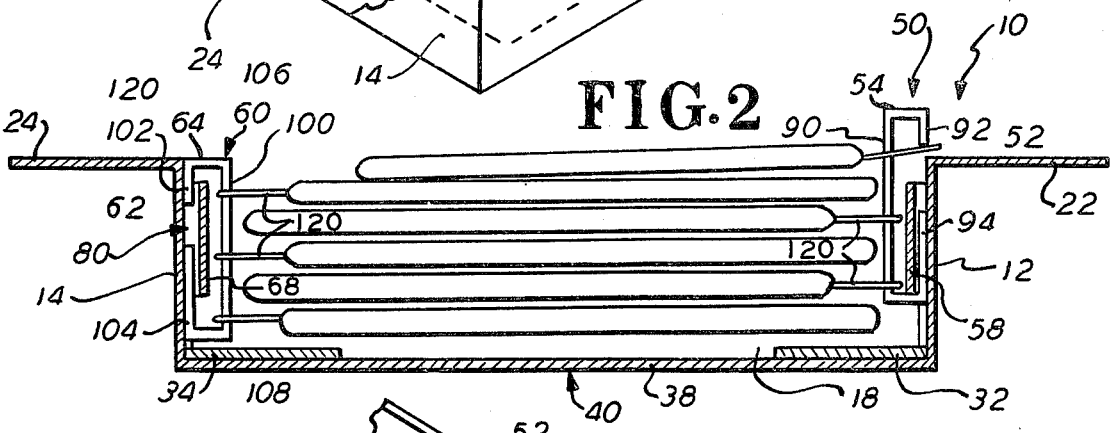
FIG. 2 is a vertical sectional view taken on line 2—2 of FIG. 1.

With reference to FIGS. 1 and 2 there is generally shown at 10 a relatively flat container having oppositely disposed end panels 12, 14 and side panels 16, 18 all formed for corrugated board and interconnected in conventional manner. Upper end flaps 22, 24 and side flaps 26, 28 extend from end panels 12, 14 and side panels 16, 18 in conventional manner so that when closed they provide a secure and appropriate top for container 10. Similar lower end panels 32, 34 (FIG. 2) and lower side panels 36, 38 extend from end panels 12, 14 and side panels 16, 18 respectively so that when folded into place, in conventional manner, they form a bottom 40 for container 10.

End panel 12 has affixed thereto a hanger bar retaining assembly 50; including a hanger bar retaining plate 52, a hanger bar 54 and a pair of retaining plate securing panels 56, 58. End panel 14 has affixed thereto a similar hanger bar retaining assembly 60; including a hanger bar retaining plate 62, a hanger bar 64 and a pair of retaining plate securing panels 66, 68. Retaining plate 52 is formed of metal with an embossed center rib 70 spanned by end sections 72, 74. It is secured in place, against inner surface of end panel 12, by having its sections 72, 74 lodgedd behind panels 56, 58 respectively. Panels 56, 58 are secured against the inner surface of end panel 12 by use of suitable adhesive. In similar manner retaining plate 62 is also formed of metal and with an embossed center rib 80 spanned by end sections 82, 84. It is secured in place, against the inner surface of end panel 14, by having its sections 82, 84 lodged behind panels 66, 68 respectively. Panels 66, 68 are secured against the inner surface of end panel 14 by use of suitable adhesive.

Hanger bars 54, 64 are each fabricated from suitable metal and into a modified "C" configuration so as to have: hanger bar plates 90, 100; upper back flanges 92, 102; lower back flanges 94, 104; all interconnected by upper ribs 96, 106 and lower ribs 98, 108 respectively.

Figure 3:
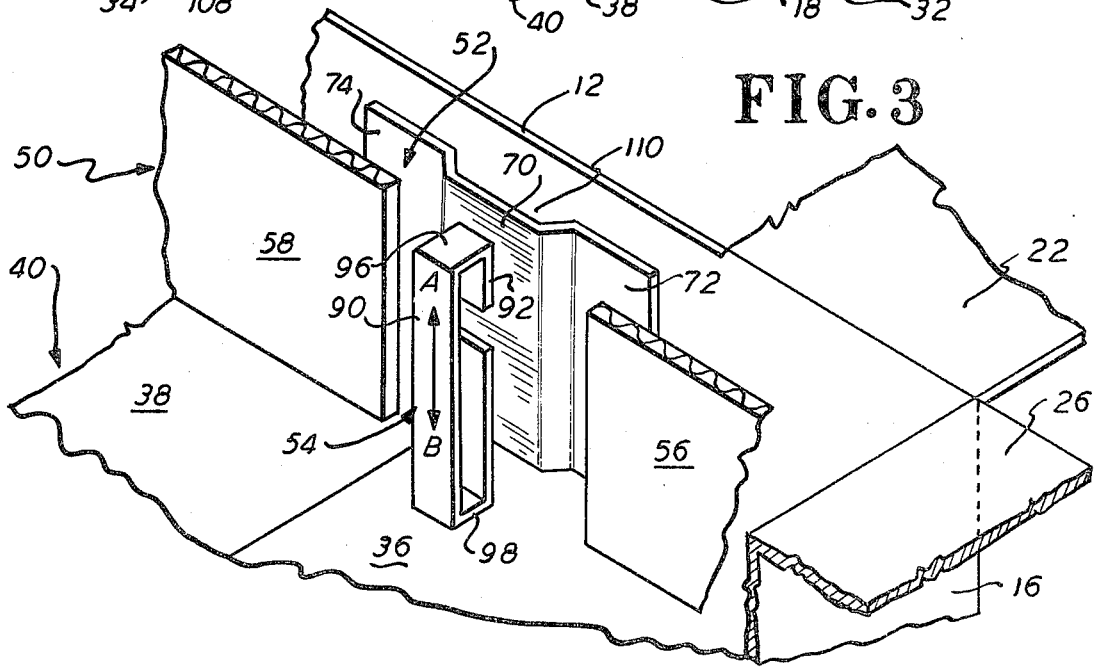
FIG. 3 is an enlarged perspective view of one of the hanger ends of the container of FIGS. 1 and 2 showing parts in exploded relationship, and cut away in part, to better show details thereof.

Back flanges 92, 94, 102, 104 are of a configuration and size to slidably fit within channels 110, 120 formed respectively behind center ribs 70, 80 when retaining plates are secured in position with their respective end panels 12, 14. The sliding action of bars 54, 64 is in the directions of arrows A and B (FIG. 3). The configuration and size of hanger bars 54, 64 is also selected so that the distance between the lower extremity of upper back flanges 92, 102 and the inner surface of lower back flanges 94, 104 respectively is slightly greater than the height of retaining plates 52, 62. As such once hanger bars 54, 64 are in place they be be slid in the direction of arrow A and pulled forward at their tops (as shown in FIG. 2) to allow hangers 120 to be hooked behind bar plates 90, 100. When all the hangers are in place hanger bars 54, 64 are slid in the direction of arrow B (FIG. 3) so that upper flanges 92, 102 are slid behind ribs 70, 80. This locks hanger bars 54, 64 in place (as shown for hanger bar 64 in FIG. 2) and hangers 120 in place behind bar plates 90, 100 respectively.

Hanger bars 54, 64 are initially installed behind plates 52, 62, when container 10 is first set up, by sliding lower back flanges 94, 104 up behind center ribs 70, 80. Once container 10 is set up it becomes impossible, due to the size of lower back flanges 94, 104, for hanger bars 54, 64 to be fully dislodged.

It is important to note that hanger bars 54, 64, plages 52, 62 and securing panels 56, 58, 66, 68 may be fabricated from other materials than those described. Suitable plastics and corrugated board may be utilized. If desired retaining plates 52, 62 may be otherwise secured in place.

Once a container 10 has been assembled and set up garments 122 on hangers 120 may be laid into container 10 with their hangers 120 alternatively disposed on hanger bars 54, 64 respectively. When container 10 is filled bars 54, 64 are locked in place (as previously described) and upper flaps 22, 24, 26 and 28 closed and, if desired, sealed.

From the above description it will thus be seen that there has been provided a novel and improved container for garments, which container utilizes relatively simple to operate and inexpensive retaining means for securing hangers, upon which the garments are hung, in alternative fashion from opposite ends of the container and thus helps maximize the number of garments that can be placed in the container.

It is understood that although I have shown the preferred form of my invention that various modifications may be made in the details thereof without departing from the spirit as comprehended by the following claims.

I claim:

1. A garment container; comprising (a) container means defined by a plurality of walls and of a size and configuration to hold at least one garment when disposed on a garment hanger; and (b) hanger retaining means carried by said container means proximate at least an inner surface of one of said walls;

(c) said hanger retaining means including hanger holding means slidably disposed for co-action with holder retaining means, secured to said inner surface of said one of said walls, for movement between a first position wherein said hanger holding means is disposed to receive a predetermined part of a hanger and a second position wherein said hanger holding means secures the predetermined part of the hanger; and thereby the hanger, in position within said container means, and wherein said holder retaining means is secured to said inner surface of said one of said walls by panel means adhesively secured to said inner surface of said one of said walls so as to lodge said holder means between at least a part of said panel means and said inner surface of said one of said walls, said panel means includes a pair of panels disposed one to each side of said holder retaining means.

2. The garment container of claim 1: wherein said holder retaining means is formed with rib means of a predetermined configuration and disposition to receive at least a portion of said hanger holding means for movement between said first and said second positions.

3. The garment container of claim 2: wherein said rib means comprise an elongated embossed rib so disposed, when said holder retaining means is secured in place, as to form a channel between said inner surface of said wall and said holder retaining means.

4. The garment container of claim 3 wherein said hanger holding means is fabricated in the configuration of a modified "C" with a holder bar terminating in a pair of back flanges of a size and configuration to slidably fit into said channel.

5. The garment container of claim 4: wherein said back flanges terminate with their respective ends spaced one from the other and sized so that when said hanger retaining means is moved to said first position said holder bar may be pulled away from said holder retaining means without dislodging at least one of said back flanges from said channel.

6. The garment container of claim 5: wherein hanger retaining means are disposed proximate the inner surface of opposite ones of said walls.

7. The garment container of claim 6: wherein said hanger retaining means are of a size and configuration to receive garments on hangers in layers with the hangers alternating to each of said opposite walls so as to maximize the number of garments to be disposed in said container means.

* * * * *